United States Patent [19]

Dressler et al.

[11] Patent Number: 4,650,694

[45] Date of Patent: Mar. 17, 1987

[54] METHOD AND APPARATUS FOR SECURING UNIFORMITY AND SOLIDITY IN LIQUID JET ELECTROSTATIC APPLICATORS USING RANDOM DROPLET FORMATION PROCESSES

[75] Inventors: John L. Dressler, Spring Valley, Ohio; Bobby L. McConnell, Greensboro, N.C.; Michael I. Glenn, Burlington, N.C.; Joseph P. Holder, Greensboro, N.C.

[73] Assignee: Burlington Industries, Inc., Greensboro, N.C.

[21] Appl. No.: 729,412

[22] Filed: May 1, 1985

[51] Int. Cl.[4] ..... B05D 1/04

[52] U.S. Cl. ..... 427/32; 427/27; 346/75

[58] Field of Search ..... 427/27, 32; 346/75

[56] References Cited

U.S. PATENT DOCUMENTS

| | | | |
|---|---|---|---|
| 3,915,113 | 10/1975 | Paton | 118/625 |
| 4,065,773 | 12/1977 | Berry | 346/75 |
| 4,087,825 | 5/1978 | Chen | 346/75 |
| 4,326,204 | 4/1982 | Erin | 346/75 |
| 4,523,202 | 6/1985 | Gamblin | 346/75 |

*Primary Examiner*—Richard Bueker

*Attorney, Agent, or Firm*—Nixon & Vanderhye

[57] ABSTRACT

Uniform application of a controlled relatively small liquid volume per unit area to a moving fabric substrate is obtained even though application is made using a liquid jet electrostatic applicator which employs random drop formation processes. Repetitive print times during which randomly formed droplets are passed onto the substrate along a linear orifice array are controlled so as to have a minimum duration sufficiently large as to average out expected random variation in droplet formation processes occurring along the orifice array. At the same time, the center-to-center spacing of each printed pixel (during which randomly formed droplets are intercepted so as not to fall onto the substrate) is controlled so as to maintain a desired relatively small controlled liquid volume per unit area within the fabric substrate section to be printed. In one exemplary embodiment, the print times are maintained in excess of approximately 200 microseconds and/or so as to insure that the expected standard deviation of liquid volume printed onto the substrate during each print time is less than approximately 0.2.

12 Claims, 8 Drawing Figures

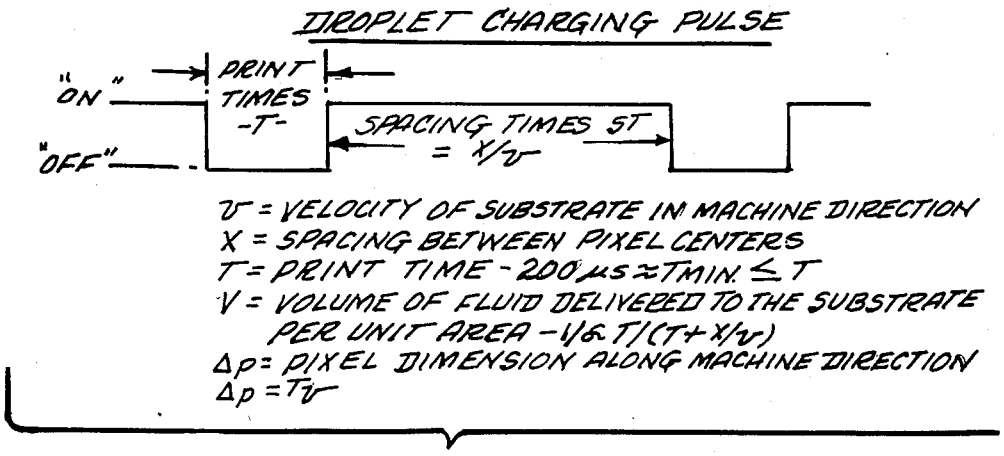
FIG. 2
FIG. 3
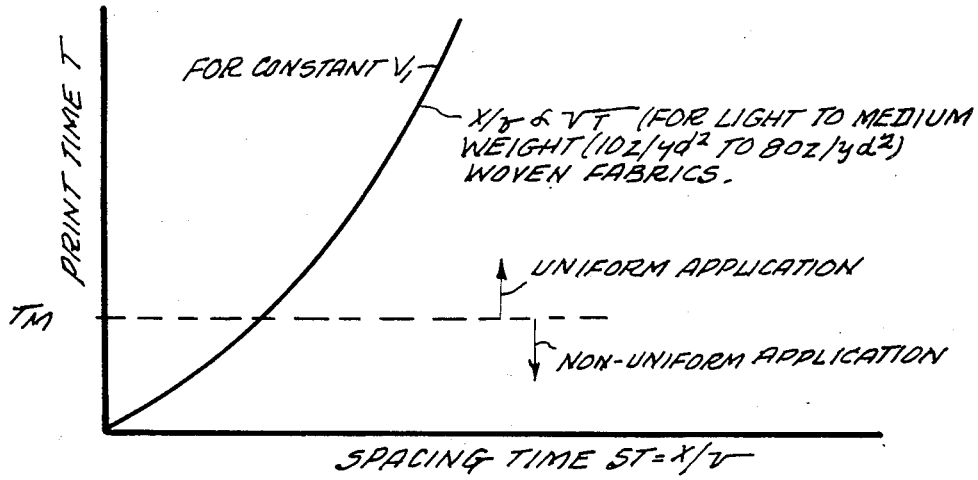
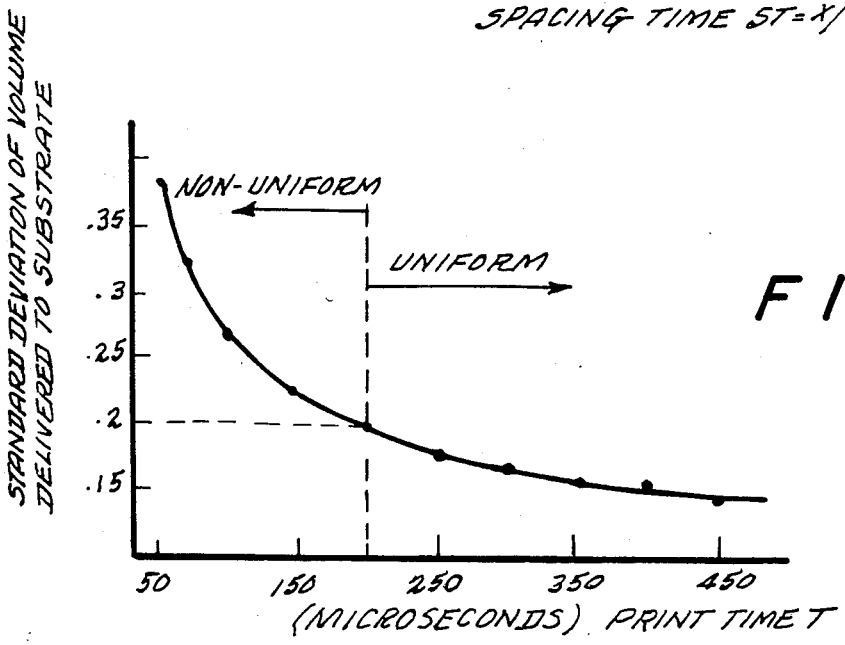
FIG. 4

80 μS - PRINT PULSES AT .016" SPACING

102 μS - PRINT PULSES AT .016" SPACING

250 μS - PRINT PULSES AT .030" SPACING

400 μS - PRINT PULSES AT .040" SPACING

METHOD AND APPARATUS FOR SECURING UNIFORMITY AND SOLIDITY IN LIQUID JET ELECTROSTATIC APPLICATORS USING RANDOM DROPLET FORMATION PROCESSES

This invention is generally directed to method and apparatus for achieving uniform application of liquids onto substrate surfaces while using a liquid jet electrostatic applicator which employs random droplet formation processes along a linear orifice array. The invention is particularly useful in the textile industry where such an applicator may be used to apply liquid dye, for example, and uniform application thereof is required so as to provide color or shade solidity (i.e., uniformity of treatment by the dyestuff) throughout the surface and depth of a treated fabric substrate.

There are many types of control circuits that have been employed in the past for controlling the application of various substances to moving surfaces. A non-exhaustive sample of prior issued U.S. patents generally directed to such control functions is set forth below:

U.S. Pat. No. 3,909,831—Marchio et al (1975)
U.S. Pat. No. 4,013,037—Warning, Sr. et al (1977)
U.S. Pat. No. 4,065,773—Berry (1977)
U.S. Pat. No. 4,087,825—Chen et al (1978)
U.S. Pat. No. 4,164,002—Patnaude (1979)
U.S. Pat. No. 4,167,151—Muraoka et al (1979)
U.S. Pat. No. 4,326,204—Erin (1982)
U.S. Pat. No. 4,357,900—Buschor (1982)
U.S. Pat. No. 4,389,969—Johnson (1983)
U.S. Pat. No. 4,389,971—Schmidt (1983)

Of this group, Berry, Chen et al and Erin appear to be directed to ink jet printing apparatus and thus possibly are more relevant than the other references. Erin, for example, synchronizes drop charging potential pulses with both a frequency of a droplet stimulation signal and the substrate movement so as to provide an improved density control for a coating. While Erin thus discloses varying the duty cycle of "print time" so as to control the density of coating, he does not appear to contemplate also varying the frequency of such print time intervals (i.e., the spacing between print time pulses) nor is Erin directed to solution of the problem which occurs when random droplet generation processes are employed.

Chen et al is similarly directly to a periodically perturbed system which merely adjusts the volume of liquid being delivered without also controlling the frequency of print pulses per unit distance along the substrate. Berry discloses a facsimile system capable of generating gray tones by averaging the number of drops deposited over a given number of dot locations to effectively generate fractional drop intensities. A high frequency periodic perturbation of 400 KHz is disclosed. Once again, the center-to-center spacing between pixel or dot elements on the substrate appears to be of relatively fixed size.

Accordingly, while the prior art does appear to teach apparatus (in somewhat different contexts) capable of generating variable duty cycle "print" pulses, it does not appear to teach the present invention. For example, there is not even so much as a suggestion of the non-uniformity problem encountered when random droplet generating processes are employed in conjunction with relatively small print time intervals. Nor is there any suggestion that such a problem can be overcome by maintaining a sufficiently large minimum print time interval in conjunction with control over increased center-to-center pixel spacing on the substrate so as to maintain control over the average volume per unit area delivered to the substrate and thus achieve the desired results, for example, in the textile industry.

As explained in the commonly-assigned copending U.S. patent application Ser. No. 428,490, filed Sept. 28, 1982 to Gamblin, if "ink" (actually many suitable liquid treatments may be used) jet electrostatic printing techniques are to be employed generally in the textile industry, random droplet formation processes are preferably utilized—as opposed to the more conventional use of regular periodically stimulated droplet formation processes.

In brief, the need for random droplet formation processes arises from the fact that typical textile applications may require cross-machine orifice arrays considerably in excess of the approximately only 8–10 inches cross-machine dimension typically utilized for printing onto paper of standard letter and legal sizes where regular periodically stimulated non-random droplet formation processes are purposely employed. When cross-machine dimensions much larger than 8–10 inches are required (e.g., perhaps up to approximately 1.8 meters in many typical textile applications), such regular periodic acoustic stimulation of the liquid so as to produce a non-random droplet formation process inevitably generates standing acoustic waves (or other adverse phenomena) within the applicator and/or liquid so as to generate undesirable variations in printing quality along the cross-machine dimension. For example "cusps" and/or "nulls" in the quantity of delivered liquid may form along the elongated cross-machine orifice array. To avoid such standing waves or other adverse phenomena (and thus to permit longer cross-machine dimensions for single orifice arrays), Gamblin has proposed the purposeful employment of random droplet formation processes. As explained more fully in the above-referenced application, Gamblin proposes either (a) utilizing no stimulation at all (but even this probably inherently utilizes naturally occurring random acoustic vibrations or other ambient random processes to stimulate random droplet formation as described by Lord Rayleigh over a century ago) or (b) purposefully generating non-periodic (i.e., noise or pseudo-random) stimulations in the fluid jets issuing from orifices along a linear array of such orifices and thus causing a random droplet formation process to occur along the array. Since there are no coherent sources of regular periodic acoustic energy within the system, the maintenance of standing acoustic waves is necessarily avoided (i.e., because there are no regular coherent travelling waves moving in opposite directions so as to constructively add and subtract thus forming cusps and nulls in a standing pressure wave pattern) nor are other such adverse phenomena permitted to exist. Typically, random or pseudo-random electrical signals are generated and fed to an electroacoustic transducer which is acoustically coupled to the liquid jets as they stream outward from the orifices.

In other words, there are situations in which it is either desirable or necessary to utilize random droplet formation processes within a liquid jet electrostatic applicator. The random drop formation processes may be entirely natural (i.e., totally without any artificial drop formation stimulation) or with use of a randomized artificial stimulation process. In this context, a single linear array of liquid jet orifices is typically employed to randomly generate a corresponding linear array of downwardly falling droplets formed at random time intervals and having a random distribution of droplet sizes. During a given "print time" interval, the droplets then passing by a charging electrode zone will *not* be charged and thus they will continue falling downward to impact with a substrate (e.g., a textile fabric) positioned therebelow (i.e., so as to be dyed, printed or otherwise treated by the liquid). Between such "print time" intervals are located spacing time intervals during which the droplets *are* charged and subsequently deflected downstream in a further electrostatic field toward a droplet catching structure.

One of the reasons that liquid jet electrostatic applicators were thought to have potential advantage in the textile industry is that it was hoped that one might achieve a fairly tight control over the amount of fluid that is actually applied to the textile in a given treating process (e.g., dyeing). In many conventional textile liquid treatment processes, a considerable amount of excess "add-on" liquid is necessarily applied to the textile. Subsequently, much effort and expense are typically encountered in removing this excess fluid from the textile. For example, some of the excess might be physically squeezed out of the textile (e.g., by passage through opposed rollers) but much of it will have to be evaporated by heated air flows or the like. This not only requires considerable investment of equipment, energy, time and real estate, it also often produces a contaminated flowing volume of air which must be further treated before it is ecologically safe for discharge. In addition, there is an obvious loss of the sometimes precious treating material itself—unless it is somehow recaptured and recycled which in itself involves yet further additional expense, effort, etc.

Accordingly, if one can somehow apply only the needed amount of liquid "add-on" treatment to a fabric, there is considerable economic advantage to be had.

At the same time, in many applications (e.g., textile dyeing operations), the treating liquid must be uniformly distributed throughout the treated substrate if one is to achieve a commercially acceptable product. Furthermore, in typical commercial environments, it will be necessary for a single apparatus to successfully treat a wide variety of different types of textile substrates each having different requirements if one is to achieve uniformity.

For example, for solid shade dyeing in textile applications, the liquid jet applicator must be able to apply fluid in a uniform fashion to an entire range of commercial fabrics. Different styles of fabric vary considerably in terms of fiber content, construction, weave and preparation. These general parameters, when combined, in turn determine relative physical properties and characteristics of a given fabric such as porosity, weight, wettability, capillary diffusion (wicking) and the like. As will be appreciated, the volume of fluid per unit surface area required to adequately treat a given fabric is greatly influenced by these physical properties.

In order to control the volume of liquid per unit area passing onto the substrate moving therepast in a liquid jet electrostatic applicator, it was initially thought that one would merely have to control the duty cycle or "print time" of a fixed repetitive total cycle time interval (assuming a constant substrate velocity). That is, if a given print time is assumed to deposit a "packet" of droplets to form a corresponding printed "pixel" (i.e., a "picture element") on the substrate, and if the center-to-center pixel spacing is fixed at some predetermined small increment (e.g., 0.010 inch or 0.016 inch), then it was initially assumed that one merely had to control the volume of liquid deposited in each such closely-spaced pixel area to control the overall volume of applied liquid per unit area.

However, when actual laboratory experiments were run and applied "add-on" fluid volumes were thus controlled, it was found necessary to reduce the print time to durations of relatively small magnitudes (e.g., on the order of 50–100 microseconds). In this manner, it was expected that only relatively small "packets" of droplets (hence small volumes of liquid) would impinge upon each of relatively closely-spaced center points in the textile medium such that the expected droplet spread diameter (typically wicking on the order of ten times the drop diameter can be expected in a fabric) would ultimately result in a uniform distribution of dyestuff within the textile medium.

Surprisingly, this straightforward approach did *not* produce uniform liquid applications. Instead, attempts to use this early approach revealed severe non-uniformity in the delivered liquid volumes along the linear orifice array. Further experiment and subsequent statistical analysis have revealed that the standard deviation of delivered liquid volumes along the linear orifice array increases exponentially as the print time interval is decreased. This result was evident not only in measured volumes of elements across the linear orifice array but also in the visual and optically measured appearance of dyed or printed textile substrates. It was discovered, for example, that when print time intervals on the order of 75–100 microseconds were employed (for center-to-center pixel spacings of 0.016 inch), volume variations in delivered liquid along the linear array are on the order of ±25%. Once this problem became apparent, it appeared to present a possibly insurmountable obstacle in the path of a desired uniform dye shade liquid jet electrostatic applicator machine using random droplet formation processes.

However, further consideration has led to a better understanding of the phenomena underlying this problem of apparent non-uniformity when print times are reduced significantly to controllably limit the average liquid volume per unit area being applied to the fabric. For example, although the term "random droplet formation processes" necessarily implies lack of regular or periodic droplet formation, nevertheless a statistical average or mean droplet formation rate in such systems is predetermined by system parameters such as the liquid (e.g., its viscosity), the liquid pressure acting on the orifices, and the orifice diameter. For systems thought to be of interest in the textile industry, the mean or average random droplet formation rate is typically in the range of 20,000 to 50,000 drops per second (i.e., one drop every 20 to 50 microseconds). Once that fact is in hand, it can be seen that the relatively short print times of 50–100 microseconds earlier referenced mean that only a relatively few (e.g., two or three) droplets can, on the average, be expected to constitute the "packet" of droplets selected for printing purposes during such a short print time. Accordingly, random variations in the number of such droplets (e.g., the addition or subtraction of one such droplet) within a given print time interval will result in a considerable variation in the total volume of fluid delivered during a given unit print time interval. The result was the observed nonuniformity of printing volumes released along the linear orifice array at any given time and, therefore, deposited upon the imprinted fabric or other substrate medium.

Once these phenomena were better understood, it was then observed that improved uniformity of delivered liquid volume per unit distance along the orifice array could be obtained only by using print times in excess of approximately 200 microseconds (e.g., where the statistical standard deviation of volume delivered to the substrate is expected to be no more than about 0.2) with continued increases in uniformity being observed as the print time intervals were increased. Unfortunately, however, such increased print time intervals (now known to be necessary to achieve the desired uniformity of delivered liquid volume per unit distance along the linear array orifice) also increased the average overall volume being delivered per unit area of the textile substrate being dyed or printed. Such increases in delivered volume per unit area directly conflict with the desired advantage of providing only the optimum required amount of "add-on" liquid (e.g., low wet pickup dyeing of textiles) so as to avoid subsequent problems caused by the use of excess liquid volumes in the first place.

Even though the center-to-center pixel spacings on the substrate had earlier been selected and fixed for a given fabric at distances where the expected wicking or other diffusion processes would result in uniform distribution of applied liquid between the pixel centers, it was next theorized that since increased delivered volumes were now being supplied in each packet of droplets at a given pixel site, one might be able to move the pixel centers further apart and still maintain uniform final distribution—but now *without* the use of excess "add-on" liquid volume. That is, it was theorized that the above-stated problems might all be simultaneously overcome if one were to maintain relatively longer minimum print times (so as to average random variations in the number of droplets occurring along the linear array during any given print time) *coupled with* correspondingly longer elapsed time intervals *between* such print times (i.e., larger center-to-center pixel spacings). Further restated, the minimum amount of fluid being delivered to each pixel on the textile substrate during each print time was increased but the linear spacing on the substrate between such pixels was simultaneously increased so as to still achieve only the desired optimum overall volume/weight of liquid per unit area being delivered to the textile surface. (As will be appreciated, if the textile substrate is moved at a known given relative velocity in the longitudinal or "machine" direction, then the spacing interval distance on the substrate will also correspond to a given known time interval.)

Color uniformity of commercial fabric is judged not only across one surface, but also front-to-back, side-to-side and even within the thickness of the fabric. Overall color must be uniform in each of these areas for the product to be commercially acceptable. In normal "pad" dyeing, the pad pressure forces dye (i.e., by direct contact) into the fabric interior from both sides of the cloth. This assures that all areas of the substrate are exposed to the dye and results in uniform color throughout the fabric.

Liquid jet electrostatic application, on the other hand, being a non-contact form of application does not impart any significant mechanical work to the fabric in the dyeing process so as to aid in color distribution on the substrate. Rather, dye or color uniformity is achieved solely by movement of the fluid itself once it is deposited at a given location on the fabric surface. In textile applications, such movement is governed to a large extent by the physical properties and characteristics of the fabric as previously mentioned. These parameters determine how well a dye can move within the fabric microstructure and, thus, the degree to which the dye can become distributed within the fabric. Such parameters can differ drastically among fabrics.

Since fabric characteristics are to a large extent fixed by consumer demands, only the application parameters of the instrument are available for manipulation so as to assure uniform coloring of the fabric, these parameters being, for example, orifice size, print pulse width and pixel spacing. Orifice size and fluid pressure and the like are primarily set by the maximum fluid volume requirements so as to cover a given range of fabrics to be processed by a given machine setup. In the exemplary embodiment of this invention, the desired degree of fluid "add-on" (i.e., the average volume per unit area of fluid delivered to the substrate surface) is controlled by maintaining the print pulse width above a predetermined minimum level while at the same time adjusting the center-to-center pixel spacing as may be required. In this manner, a greater range of fabrics may be satisfactorily treated by a single machine setup of a liquid jet electrostatic applicator utilizing random droplet formation processes.

The area of textile surface dyed or printed due to the impingement of a single packet of randomly formed droplets generated by a single orifice has been observed empirically to increase roughly as the square root of the selected print time. That is, for an increase of print time of 2X, a corresponding increase in the longitudinal or machine direction center-to-center spacing of pixels or print "packets" of droplets upon the substrate of 1.4142X would be required. This relationship is believed to be affected by the physical properties and characteristics of a given textile medium but has been observed to be generally true for light to medium weight (e.g., 1 to 8 ounces per yard) woven fabrics. In the exemplary embodiment, typical values of print times and longitudinal spacing range from 250 microseconds at 0.030 inch center-to-center pixel spacing to 550 microsecond print times at 0.040 inch center-to-center pixel spacing. It should be noted that these values are typical but in no way limit the scope of the invention in that each individual substrate will require its own distinct set of operating parameters.

These as well as other objects and advantages of this invention will be better appreciated by reading the following detailed description of the presently preferred exemplary embodiment taken in conjunction with the accompanying drawings, of which:

FIG. 1 is a schematic depiction of a liquid jet electrostatic applicator using random droplet formation processes with appropriate circuitry for controlling both the minimum print time interval and the frequency with which print pulses are generated as a function of distance along the substrate to be treated so as to control the average "add-on" volume of liquid per unit area applied to the substrate while yet achieving uniformity of such application;

FIG. 2 is a schematic depiction of the relationship between repetitive print times T and spacing times ST for the apparatus of FIG. 1;

FIG. 3 is a graph showing the observed parabolic relationship between print time T and spacing time ST for constant delivered volumes V per unit area of the substrate;

Figure 5:
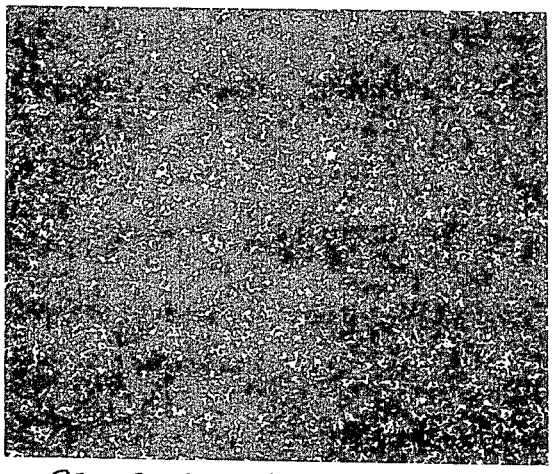
Figure 6:
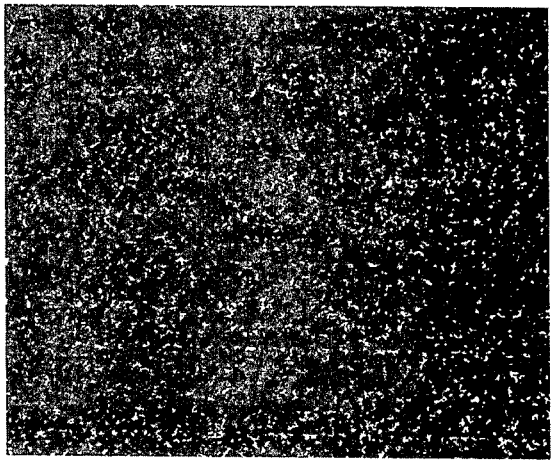
Figure 7:
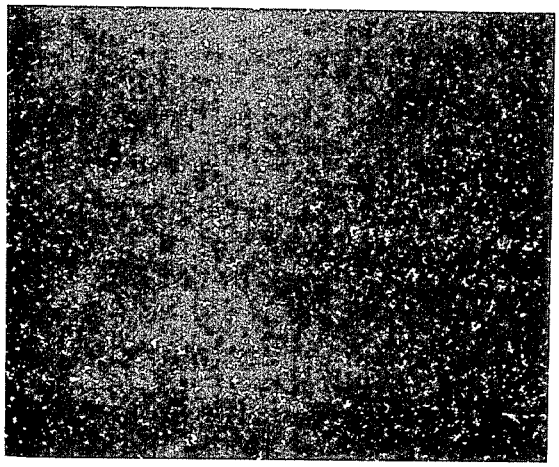
Figure 8:
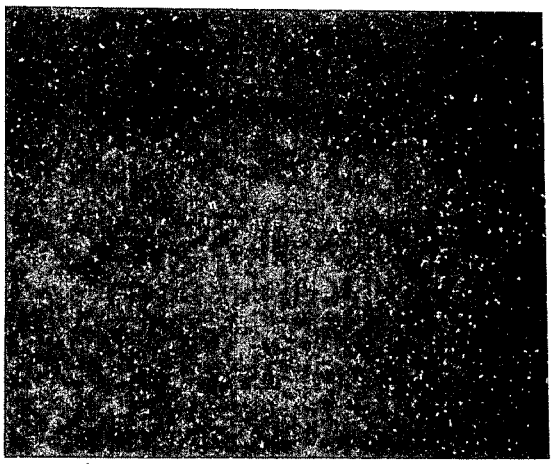

FIG. 4 is a graph of empirical data showing the observed exponential relationship between the statistical standard deviation of liquid volume delivered to the substrate and print times T; and FIGS. 5–8 are photographs of a paper substrate (having much less wicking capability than fabric and therefore continuing to show some non-uniformity which, in FIGS. 7–8, would actually be uniform in a fabric substrate due to its greater wicking ability) at various print time pulse durations and spacing,intervals therebetween.

Figure 1:
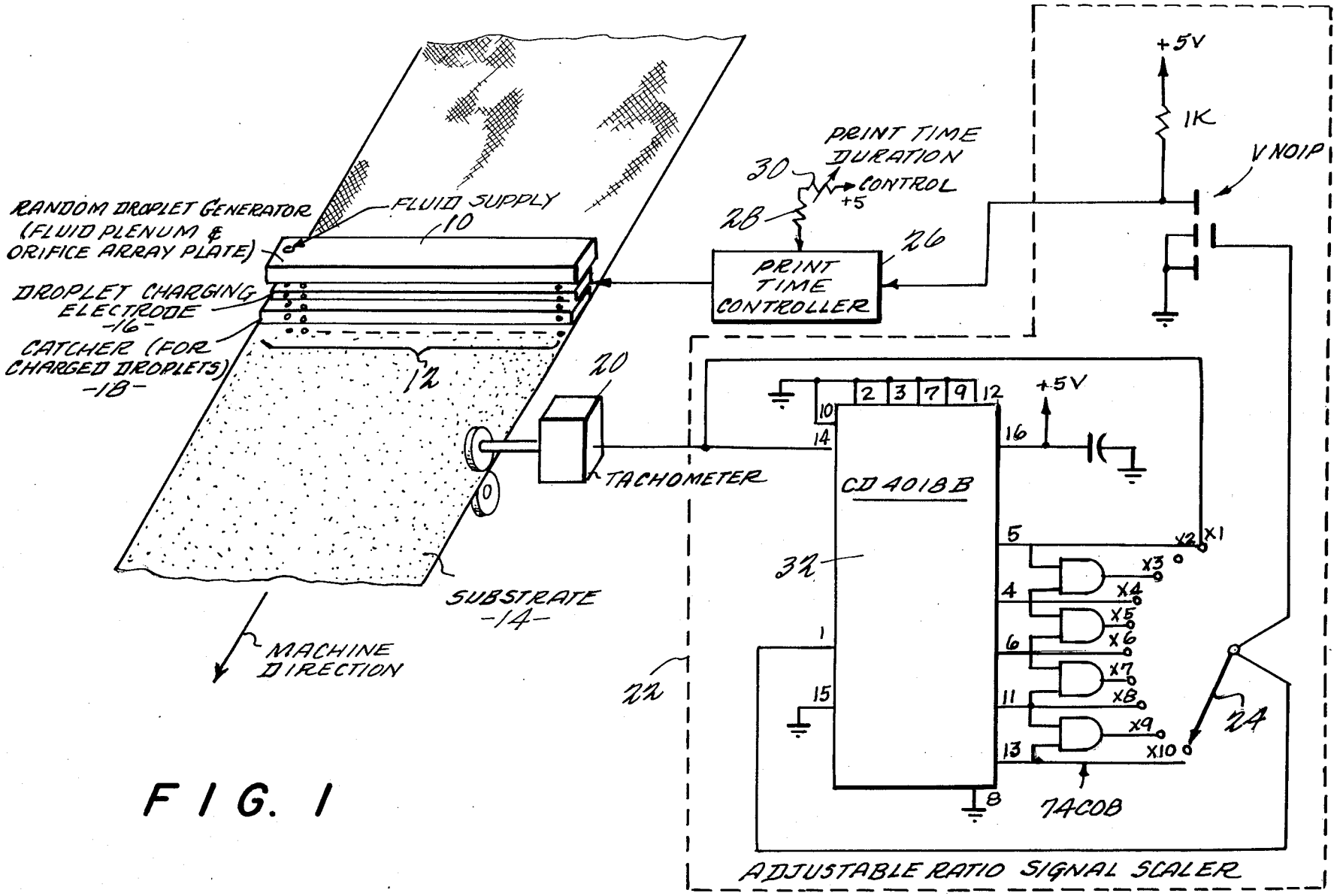

A typical fluid jet electrostatic applicator using random droplet generation processes is depicted in FIG. 1. As shown, it includes a random droplet generator 10. Typically, such generator will include a suitable pressurized fluid supply together with a suitable fluid plenum which therein supplies a linear array of liquid jet orifices in a single orifice array plate disposed to emit parallel liquid streams or jets which randomly break into corresponding parallel lines of droplets 12 falling downwardly toward the surface of a substrate 14 moving in the machine direction (as indicated by an arrow) transverse to the linear orifice array. A droplet charging electrode 16 is disposed so as to create an electrostatic charging zone in the area where droplets are formed (i.e., from the jet streams passing from the orifice plate). If the charging electrode 16 is energized, then droplets formed at that time within the charging zone will become electrostatically charged. A subsequent downstream catching means 18 generates an electrostatic deflection field for deflecting such charged droplets into a catcher where they are typically collected, reprocessed and recycled to the fluid supply. In this arrangement, only those droplets which happen *not* to get charged are permitted to continue falling onto the surface of substrate 14.

The random droplet generator 10 may employ absolutely no artificial droplet stimulation means or, alternatively, it may employ a form of random, pseudo-random or noise generated electrical signals to drive an electroacoustic transducer or the like which, in turn, is acoustically coupled to provide random droplet stimulation forces. As previously explained, such random droplet generating forces are often preferred so as to avoid standing waves or other adverse phenomena which may otherwise limit the cross-machine dimensions of the linear orifice array extending across the moving substrate 14.

As also explained above, it is very desirable (especially in the context of textile applications) to achieve a uniform application of a controlled liquid volume per unit area of substrate so as to avoid the application of any "excess" treating liquid and the attendant problems otherwise to be encountered.

To achieve the necessary control and also achieve the desired uniformly treated textile substrate, the system of FIG. 1 provides an apparatus for electronically adjusting the center-to-center pixel spacing between occurrences of individual print time pulses along the longitudinal or machine direction of substrate motion so as to provide a uniform solid shade dye or other fluid application (or even simply to provide uniformity within the solid portions of a given pattern application) by one or all of the ink jets within the linear orifice array, so as to make the apparatus usable on a relatively wider range of commercially desirable textile products. This adjustment of center-to-center pixel spacing in conjunction with proper control over the print time duration at each pixel site provides the desired result.

In particular, in the exemplary embodiment of FIG. 1, a tachometer 20 is mechanically coupled to substrate motion. For example, one of the driven rollers of a transport device used to cause substrate motion (or merely a follower wheel or the like) may drive the tachometer 20. In the exemplary embodiment, the tachometer 20 may comprise a Litton brand shaft encoder Model No. 74BI1000-1 and may be driven by a 3.125 inch diameter tachometer wheel so as to produce one signal pulse at its output for every 0.010 inch of substrate motion in the longitudinal or machine direction. It will be appreciated that such signals will also occur at regular time intervals provided that the substrate velocity remains at a constant value. Accordingly, if a substrate is always moved at an approximately constant value, then a time driven clock or the like possibly may be substituted for the tachometer 20 as will be appreciated by those in the art.

Thus, by one means or another, an input signal is applied to the adjustable ratio signal scaler 22 for each passage of a predetermined increment of substrate movement in the machine direction (e.g., for each 0.010 inch). The ratio between the number of applied input signals and the number of resulting output signals from the signal scaler 22 is adjustable (e.g., by virtue of switch 24). When an output signal is produced by the signal scaler 22, then a conventional print time controller 26 generates a print time pulse for the charging electrode 16 (which actually turns the charging electrode "off" for the print time duration in the exemplary embodiment). The print time controller 26 may, for example, be a monostable multivibrator with a controllable period by virtue of, for example, potentiometers 28, 30 which may constitute a form of print time duration control. For example, the fixed resistor 28 may provide a way to insure that there is always a minimum duration to each print time pulse while the variable resistor 30 may provide a means for varying the duration of the print time pulse at values above such a minimum. As will be appreciated by those in the art, the generated print time pulses will be conventionally utilized to control high voltage charging electrode supply circuits so as to turn the charging electrode 16 "on" (during the intervals between print times) and "off" (during the print time interval when droplets are permitted to pass on toward the substrate 14).

For any given setting of switch 24, there is a fixed center-to-center pixel spacing. For example, if tachometer 20 is assumed to produce a signal each 0.010 inch of substrate movement, and if switch 24 is assumed to be in the X1 position, then the center-to-center pixel spacing will also be 0.010 inch because the print time controllers 26 will be stimulated once each 0.010 inch.

However, the input to the signal scaler 22 also passes to a digital signal divider circuit 32 (e.g., an integrated COS/MOS divide by "N" counter conventionally available under integrated circuit type No. CD4018B). The outputs from this divider 32 are used directly or indirectly (via AND gates as shown in FIG. 1) to provide input/output signal occurrence ratios of 1:1 (when the switch is in the X1 position) to 10:1 (when the switch is in the X10 position) thus resulting in output signal rates from the scaler 22 at the rate of one pulse every 0.010 inch to one pulse every 0.100 inch and such an output pulse rate can be adjusted in 0.010 inch increments via switch 24 in this exemplary embodiment. The FET output buffer VNOIP merely provides electrical isolation between the signal scaler 22 and the print time controller 26 while passing along the appropriately timed stimulus signal pulse to the print time controller 26. Thus, the center-to-center spacing of pixels in the machine direction can be instantaneously adjusted by merely changing the position of switch 24. As will be appreciated by those in the art, there are many possible electrical circuits for achieving such independent but simultaneous control over center-to-center pixel spacing and the mininum duration of print time intervals. Expanded ranges of signal ratios as well as closer or even vernier increments of signal ratio adjustments may be utilized if desired.

If the apparatus of FIG. 1 is utilized for achieving uniform solid shade coloring (e.g., dyeing) of substrates (e.g., fabrics), then the center-to-center pixel spacing becomes a limiting factor when the distance between individual pixels becomes so great that one can now perceive discrete cross-machine lines on the substrate which do not properly converge (e.g., due to wicking characteristics of the fabric so as to produce uniform coverage). This upper limit on the center-to-center pixel spacing will vary, of course, from one fabric to another due to the different physical properties of such fabrics as earlier discussed.

While the just-discussed limitation for uniform solid shade coloring exists, that very limitation can itself be productively utilized to achieve some limited patterning capability. For example, one may produce desirable patterns by purposefully creating discernible discrete lines (cross-machine stripes, for example) of constant or variable spacing along a textile substrate. A varying pattern can be created, for example, by using a variable signal ratio control circuit (e.g., by manually or electronically controlling the rate of change of switch 24 or its equivalent). By manipulating the independently controlled print time duration and/or center-to-center pixel spacing using the system of FIG. 1, discernible line patterns of variable separation, width and intensity may be achieved for particular design purposes on the substrate material.

As should be appreciated, if a two-dimensional print pattern is desired, then the droplet charging electrode 16 may be segmented to a cross-machine pixel dimension and individual pattern control over these plural charging electrodes can be superimposed with the output of the print time controller 26.

The relationship between print times T and spacing times ST is depicted graphically in FIG. 2. As shown and as previously explained, the print time T occurs when the charging electrode 16 is turned "off". If one assumes that the velocity of the substrate in the machine direction is v and if one also assumes that the signal scaler 22 is set so as to produce a predetermined center-to-center pixel spacing x, then the spacing time ST is equal to x/v. As also previously explained, the print time T should be above about 200 microseconds so as to produce a standard deviation of delivered liquid volume along the array of less than approximately 0.2 (see FIG. 4). It should also be appreciated that the volume V of fluid delivered to the substrate per unit area is proportional to the duty cycle of print time which is, $T/(T+x/v)$. Furthermore, if one assumes zero wicking capability of the substrate and theoretically perfect conditions otherwise, then the nominal pixel dimension along the machine direction $\Delta p$ will be equal to Tv. In actuality, due to wicking and other phenomena, in the preferred exemplary embodiment of a uniform dye shade applicator in the fabric or textile industries, the applied liquid at each pixel location will itself become distributed throughout the fabric substrate and therefore there will be no discernible delineations between pixel areas in the finished product.

Referring to FIG. 3, as previously mentioned, it has been observed data that for a constant delivered fluid volume V, changes in spacing times ST should be approximately proportional to the square root of the print time T. This observation has been made for light-to-medium weight (1 ounce per square yard to 8 ounces per square yard) woven fabrics. As depicted in both FIGS. 3 and 4, it has also been empirically observed that non-uniformity in liquid application can be expected for print times T less than about 200 microseconds. Alternatively stated, in view of the observed data depicted in FIG. 4 of standard deviations of volume delivered to the substrate versus print time T, the non-uniformity can also be expected when such standard deviation of delivered volume exceeds about 0.2. As will be appreciated, the exact point at which liquid application changes from a non-uniform to uniform state is a somewhat subjective determination. However, it is our present empirical observation that the just-stated limits are approximate critical operational limits for the exemplary system in which the orifice array comprised orifices of 0.0037 inch diameter spaced apart by 0.016 inch over a cross-machine dimension of 20 inches using either disperse or reactive dyes having a liquid viscosity of 1.2 cps with a fluid pressure of 4.5 psi and pseudo-random droplet stimulation with a statistical mean of about 19094 cycles per second and a standard deviation of about 2800 cycles per second.

It is difficult to visually depict the observed non-uniformity and/or uniformity using drawings or photographs such as are suitable for filing with this application. Accordingly, photographs appearing as FIGS. 5–8 have been made of a substitute paper substrate having considerably less wicking capability than is typically encountered with fabric substrates. Because of this reduced wicking capability, non-uniformities in the initial application of liquid to the substrate remain much more visible and noticeable than is the case for actual fabric substrates. FIGS. 5 and 6 illustrate in this fashion the non-uniformity which was initially observed when center-to-center pixel spacing remained fixed (e.g. at 0.016 inch) but when print time pulses were reduced to rather small values (e.g. 80 microseconds in FIG. 5 and 102 microseconds in FIG. 6) so as to obtain a desired lower "add-on" of liquid volume per unit area of substrate. Even with the greater wicking ability of fabric, this degree of non-uniformity as depicted on the paper substrate in FIGS. 5 and 6 continued to produce unacceptable non-uniformity even in the fabric medium.

On the other hand, FIGS. 7 and 8 depict the more acceptable uniform type of application which can be achieved even with random droplet formation processes by using relatively longer print time pulses (e.g. 250 microseconds in FIG. 7 and 400 microseconds in FIG. 8) coupled with relatively longer center-to-center pixel spacings (e.g. 0.030 inch in FIG. 7 and 0.040 inch in FIG. 8) so as to nevertheless maintain the desired small average "add-on" liquid volume per unit area of substrate. When the relatively more uniform applications of FIGS. 7 and 8 are applied to fabric substrates having typical greater wicking ability, substantially uniform solid dye shades have been achieved so as to provide the desired commercial grade product while avoiding application of excess liquid to the fabric substrate with the expected attendant disadvantages already discussed.

As should now be appreciated, this invention permits one to use random droplet generating processes in a liquid jet electrostatic applicator (e.g. thus-permitting larger cross-machine dimensions for use in the textile industry) while simultaneously achieving commercially acceptable uniform liquid application (e.g. to a textile substrate having given characteristics) while also simultaneously avoiding the application of excess "add-on" liquid (e.g. dye stuffs) and thus providing a significant economic advantage (e.g. when applied to the textile industry). These same desirable simultaneous results can be achieved with a single liquid jet electrostatic applicator for a relatively wider range of fabric substrates by virtue of the adjustable ratio signal scaler 22 used in conjunction with the print time controller 28 as described above.

While only one presently preferred exemplary embodiment of this invention has been described in detail, those skilled in the art will recognize that many modifications and variations may be made in this exemplary embodiment while yet retaining many of the advantageous novel features and results of this invention. Accordingly, all such modifications and variations are intended to be included within the scope of the following claims.

What is claimed is:

1. A method of obtaining uniform application of a controlled liquid volume V per unit area to a moving fabric substrate using a liquid jet electrostatic applicator which employs random drop formation processes along a linear orifice array and in which packets of randomly occuring droplets are passed onto an underlying fabric substrate from said linear orifice array only during controlled print times T between intervening spacing times ST, said method comprising the steps of:

maintaining said print time T above a predetermined minimum value, and controlling said liquid volume V by controlling said spacing time ST and the corresponding distance on the substrate between successive depositions of said droplet packets.

2. A method as in claim 1 wherein said randomly occurring droplets exhibit a predetermined statistical mean rate of droplet formation for a given liquid, a given liquid pressure and a given orifice size and wherein said predetermined minimum value of T is long enough to effectively average out random variations in droplet formation processes occurring along the linear orifice array during a given print time T by insuring that there is time within a given print time T for at least N droplets to form at said statistical mean rate of droplet formation where N is chosen to insure that the standard deviation of liquid volume printed during each time T is less than approximately 0.2.

3. A method as in claim 1 wherein N is approximately equal to four.

4. A method as in claim 1 wherein said predetermined minimum value of T is approximately 200 microseconds.

5. A method for uniformly applying a controlled liquid volume V per unit area to a moving section of fabric substrate, said method comprising the steps of:

randomly forming liquid droplets along a linear array of orifices disposed transverse to the direction of substrate movement;

controlling repetitive print times during which said randomly formed droplets are all passed onto said substrate surface from along said orifice array to have a duration sufficiently large to average out expected random variations in droplet formation processes occurring along the linear orifice array; and controlling spacing times between said print times (during which said randomly formed droplets are intercepted so as not to fall onto the substrate) so as to maintain said controlled liquid volume V per unit area of the fabric substrate section to be printed.

6. A method as in claim 5 wherein said print times are at least approximately 200 microseconds.

7. A method as in claim 5 wherein said print time is chosen so as to insure that the expected standard deviation of liquid volume printed onto the substrate during each print time is less than approximately 0.2.

8. A method for obtaining substantially uniform liquid application to a fabric substrate at a desired liquid volume V per unit area while using a liquid jet printing apparatus having random droplet formation processes, said method comprising the steps of:

randomly generating falling liquid droplets from a cross-machine array of orifices, said droplets falling past a droplet charging electrode zone and, if thereat charged, being electrostatically deflected to a droplet catcher structure but, if not thereat charged, continuing to fall downward;

passing a fabric substrate at a velocity v transversely under said orifice array along a machine direction such that uncharged droplets fall onto the passing substrate surface; and controlling said charging electrode so as to not charge droplets during repetitive predetermined print times T greater than about 200 microseconds and so as to charge droplets during intervening repetitive spacing times ST which times ST correspond to a predetermined distance along the substrate in the machine direction which results in said desired liquid volume V per unit area being substantially uniformly applied to the substrate.

9. A method as in claim 8 wherein said print times T and spacing times ST are varied while yet maintaining a constant delivered liquid volume V by maintaining changes in said print time T to be approximately proportional to the square of changes in the spacing time ST.

10. A method for securing uniformity and solidity in liquid jet electrostatic applicators using random droplet formation process for a range of fabric substrates, said method comprising the steps of:

selectively depositing packets of randomly formed droplets onto said substrate along a predetermined machine direction of substrate movement during repetitive print times T from a linear array of liquid jet orifices disposed in a transverse cross-machine direction;

variably controlling said print time T to be above a predetermined minimum time sufficiently large to substantially average out expected random variations in droplet formation processes occurring along said linear array;

independently and variably controlling center-to-center spacing along said machine direction on said substrate between said deposited packets to achieve a desired limited delivered liquid volume per unit area of substrate; and coordinating said controlled print time T and said controlled spacing so as to insure uniformity and solidity in liquid treatment of the substrate over at least a section thereof.

11. A method as in claim 10 wherein said minimum print time is approximately 200 microseconds.

12. A method as in claim 10 wherein said spacing is varied as a function of substrate movement sufficiently to provide discernible patterns of non-uniformities in the direction of substrate movement.

* * * * *